US006196292B1

(12) United States Patent
Jackson

(10) Patent No.: US 6,196,292 B1
(45) Date of Patent: Mar. 6, 2001

(54) METHOD AND APPARATUS FOR A WINDOW TREATMENT

(76) Inventor: Charles Leo Jackson, 624 Waldo St. SE., Atlanta, GA (US) 30312

( * ) Notice: Subject to any disclaimer, the term of this patent is extended or adjusted under 35 U.S.C. 154(b) by 0 days.

(21) Appl. No.: 09/480,961

(22) Filed: Jan. 11, 2000

(51) Int. Cl.[7] ..... E06B 3/48
(52) U.S. Cl. ..... 160/113; 160/115
(58) Field of Search ..... 160/113, 115, 160/84.01, 84.04, 84.05, 84.06, 89

(56) References Cited

U.S. PATENT DOCUMENTS

| | | |
|---|---|---|
| 168,221 | 9/1875 | Bryan . |
| 2,276,425 | 3/1942 | Slattery . |
| 2,506,507 | 5/1950 | Kiatta . |
| 2,836,237 | 5/1958 | Hogim . |
| 2,979,127 | 4/1961 | Brown . |
| 4,739,816 | 4/1988 | Dodich . |
| 4,799,524 | 1/1989 | Gueronprez . |
| 4,815,468 | 3/1989 | Frazer . |
| 5,121,783 | 6/1992 | Nilsson . |
| 5,341,864 | 8/1994 | Rupel et al. . |
| 5,791,390 | 8/1998 | Watanabe . |
| 5,845,691 | 12/1998 | Gaines . |

FOREIGN PATENT DOCUMENTS

| | | |
|---|---|---|
| 25288 | 10/1908 | (GB) . |

*Primary Examiner*—Blair M. Johnson
(74) *Attorney, Agent, or Firm*—Patent Focus, Inc.; Richard C. McComas

(57) ABSTRACT

A Venetian blind window covering in one embodiment comprises two individual Venetian blinds "A" and "B". The Venetian blind "A" and "B" are detachably secured together by a bridge rail or bridge housing. The "A" section has a plurality of user controllable slats operationally disposed therein. The "B" section has a plurality of user controllable slats operationally disposed therein. The "A" and "B" sections are independently controllable by the user. The user may, if desire, raise, lower, or tilt section "A" independent of raising, lowering, or tilting section "B". The window treatment "B" section of this embodiment may, if desired, be readily removed and replaced with a "C" section containing all of the attributes of the "B" section plus selected pictorial representations.

14 Claims, 4 Drawing Sheets

METHOD AND APPARATUS FOR A WINDOW TREATMENT

This patent application is related to co-pending U.S. patent application Ser. No. 08/780,585.

FIELD OF THE INVENTION

The invention relates, in general, to a window treatment. In particular, the invention relates to shades, curtains, Venetian blinds, and other types of window treatments. More particularly the invention relates to window treatments that have separate and distinct window covering sections wherein each section is attachable to the preceding section. Each window covering section contains individual controls to lift and tilt the associated shades, curtains, or Venetian blinds.

BACKGROUND OF THE INVENTION

The window treatment industry has changed over the years. Initially windows were covered with various types of materials to include cloth, wood, metal, and the like. If the viewing or sunlight through the window was desired, the window covering would normally be removed or drawn to a position that would unobstruct the view or sunlight. As the window treatment industry matured and consumer demand for convenience increased, various types of cords, curtain ties, and control mechanisms were developed to retain the window treatments in various positions to allow viewing or sunlight through the window.

A Venetian blind window treatment was developed as an alternative to simple material covering of a window. Generally, the Venetian blind comprises a head rail or housing, a bottom rail or housing, and a plurality of horizontal or vertical slats disposed intermediate the head rail and bottom rail. A pair of continuous ladder tape members or flexible slat support members would hold the slats in place. The ladder tape members, generally, are connected to the head rail and bottom rail. Each step of the ladder tape members contains one slat. A tilt control mechanism generally is provided and is connected to the ladder tape members. The tilt control mechanism allows a user to tilt the slats to a desired position. The Venetian blind window treatment may also have a lift control mechanism. The lift control mechanism has a lifting cord that traverses the head and rail, slats, and connects to the bottom rail. The lifting cord allows the user to lift or retract the Venetian blind to a desired position. All Venetian blind window treatments, prior to the present invention, provided the user with limited control of the amount of viewing area or sunlight associated with a given window. The user's choices were to positionally raise, lower, or tilt the Venetian blind. If the user's desire was to allow maximum sunlight to penetrate the window, he would have to physically remove the window treatment Venetian blind from the window fame. The user might also desire to remove a particular section of the Venetian blind and substitute a different section for special events like birthdays, Christmas, or Hanukkah. Once a Venetian blind window treatment is installed, it is impractical or difficult to remove or substitute an alternate blind for the installed blind.

Attempts, prior to the present invention, have been made to satisfy the user's desire to have easy to install, sectional, and replaceable Venetian blind window treatments. These attempts altered only the basic configuration of the above discussed Venetian blind window treatment. One such attempt provided the user with dual tilt control mechanism. The dual tilt control mechanism was generally mounted in the head rail and would control the tilt of the upper and lower slat sections of the Venetian blind window treatment. Another attempt added a second head rail spaced from the first head rail. The first and second head rails had there own separate tilt and lift control mechanism wherein the user could lift and tilt the slats associated with either the first or second tilt and control mechanism. Still further attempts were made to satisfy the user's desire for easy to install, sectional, and replaceable Venetian blind window treatments by substituting different configurations of slats made from balloon or bellows type material. These types of slats generally fan fold together producing an accordion effect clustered at either the head rail or the bottom rail. All of these attempts focused on manipulating the position of the slats relative to the fixture or head rail to which they were attached. Repositioning slats relative to the head rail does not remove slats from the Venetian blind window treatment. Adding separate controls for various sections of slats still does not aid in removing sections or replacing selected sections of the Venetian blind window treatment.

It would be desirable to have a window treatment that was easy to install, sectional, and replaceable. The window treatment would have a head rail, a bottom rail, and multiple detachable bridge rails. The detachable bridge rails would be intermediately disposed to the head and bottom rail. The detachable bridge rails would provide the needed detachability to remove or replace sections of the window treatment thereby satisfying the long felt but unresolved need of the user for easily installed, sectional, and replaceable Venetian blind window treatments.

SUMMARY OF THE INVENTION

Window treatment industries are well aware of the desires of consumers or users. Their livelihood depends on consumer satisfaction in the form of continuing or increased sales. Window treatments that satisfy the consumers need for easy to install, sectional, and replaceable will survive in the marketplace.

The present invention is a window treatment comprising a Venetian blind window covering. The Venetian blind window covering in one embodiment comprises two individual Venetian blinds that are joined together by a bridge rail or bridge housing. The bridge housing is divided into two sections "A" and "B" that are detachably secured together. The "A" section comprising a first bridge housing and a head rail or head housing and at least one slat disposed medially therebetween. The slat is supported on oppositely spaced ends by ladder tape members or flexible slat support members. The "A" section first bridge housing, head housing, and slat have individual and independent lift and tilt control mechanisms operatively mounted therein. The flexible slat support tape members are connected to the tilt control mechanism and facilitate the tilting of the slat. There is a continuous first lifting cord that traverses the lifting cord mechanism, head housing, slat, and then connects to the first bridge housing. The first lifting cord enables the user to lift the "A" section independent of the "B" section. The "B" section comprising a second bridge housing and a bottom rail or bottom housing and at least one slat disposed medially therebetween. The slat is supported on oppositely spaced ends by a second ladder tape member or flexible slat support tape members. The "B" section second bridge housing, bottom housing, and slat have individual and independent lift and tilt control mechanism operatively mounted therein. The second flexible slat support tape member is connected to the tilt control mechanism and facilities the tilting of the slat. There is a continuous second lifting cord that traverses the second lifting cord mechanism, second bridge housing, slat, and then connects to the bottom housing. The second lifting cord enables the user to lift the "B" section independent of the "A" section. The first and second bridge housings of sections "A" and "B" are formed to be mating housings i.e., the first bridge housing readily adjoins or mates with the second bridge housing in such a way as to form a secure but detachable union between the respective bridge housings.

The window treatment "B" section of this embodiment may, if desired, be readily removed and replaced with a "C" section containing all of the attributes of the "B" section plus additional features that are desired by the user. An example of a feature that would prompt the user to substitute a section "C" for a section "B" might be a Christmas scene that the user wishes to display. Naturally, a Christmas scene has special significance for a limited period of time and the user may not want a Christmas scene as a window treatment the entire year. The present invention enables the user to detachably secure a section "C" window treatment to a section "A" window treatment without removing the entire window treatment.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENT OF THE PRESENT INVENTION

Figure 3:
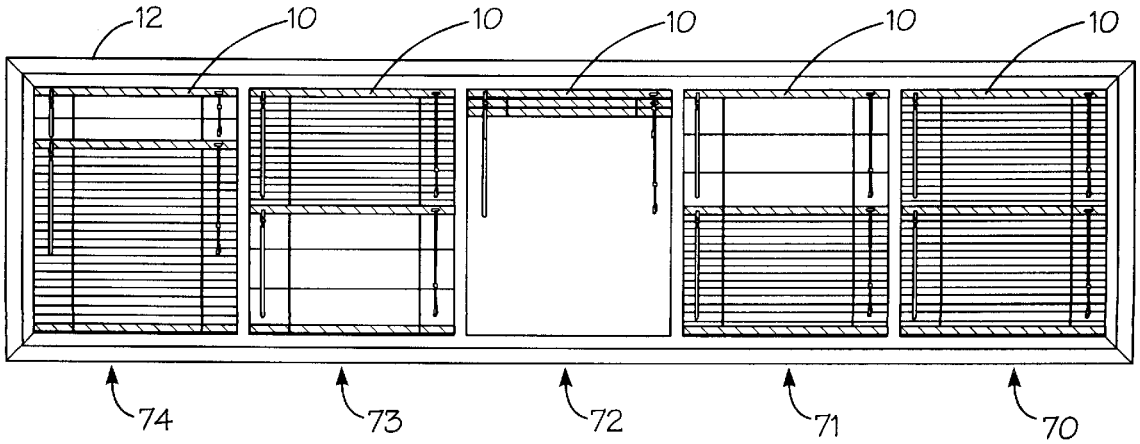
FIG. 3 illustrates a front view diagram of a plurality of preferred embodiments disposed to a window frame in multiple positions.
Figure 4:
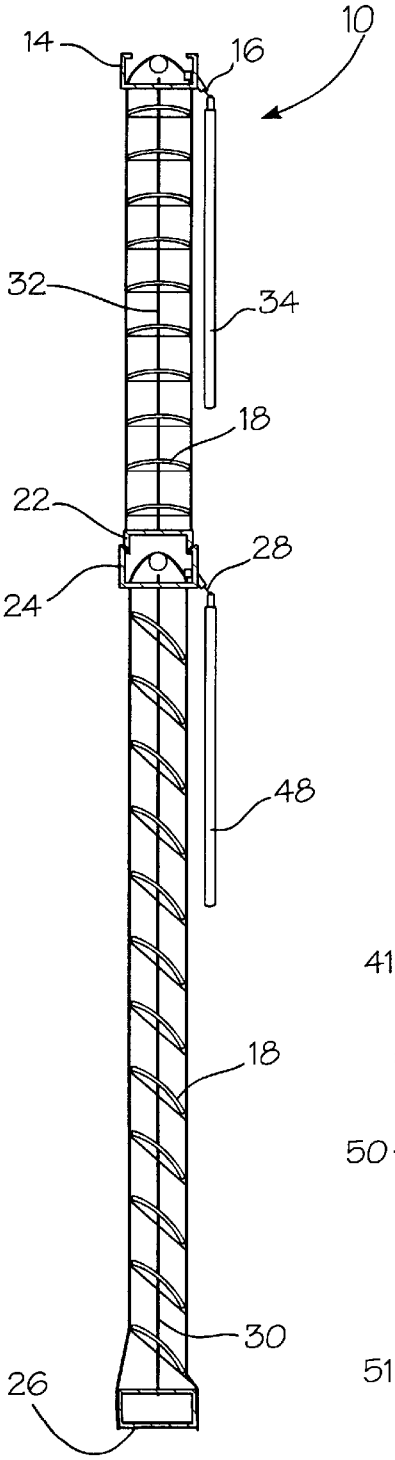
FIG. 4 illustrates a side view diagram of FIG. 2.

Before describing in detail the particular improved window treatment in accordance with the present invention, it should be observed that the invention resides primarily in a novel structural combination of conventional window treatments, discrete subsystems or subassembly components, associated control of the aforementioned window treatment and components, and not in the particular detailed configuration thereof. Accordingly, the structure, command, control, and arrangement of these conventional components and subassemblies have, for the most part, been illustrated in the drawings by readily understandable diagram representations and schematic diagrams. The drawings show only those specific details that are pertinent to the present invention in order not to obscure the disclosure with structural details which will be readily apparent to those skilled in the art having the benefit of the description herein. For example, window frame 12, FIG. 3 has numerous connections to the present invention 10. Various portions of the window frame connections to the present invention 10 have been simplified in order to emphasize those portions that are most pertinent to the invention Thus, the top level diagram and schematic diagram illustrations of the Figures do not necessarily represent the mechanical structural arrangement of the exemplary system, and are primarily intended to illustrate major hardware structural components of the system in a convenient functional grouping whereby the present invention may be more readily understood.

AN OVERVIEW OF THE PRESENT INVENTION

Figure 1:
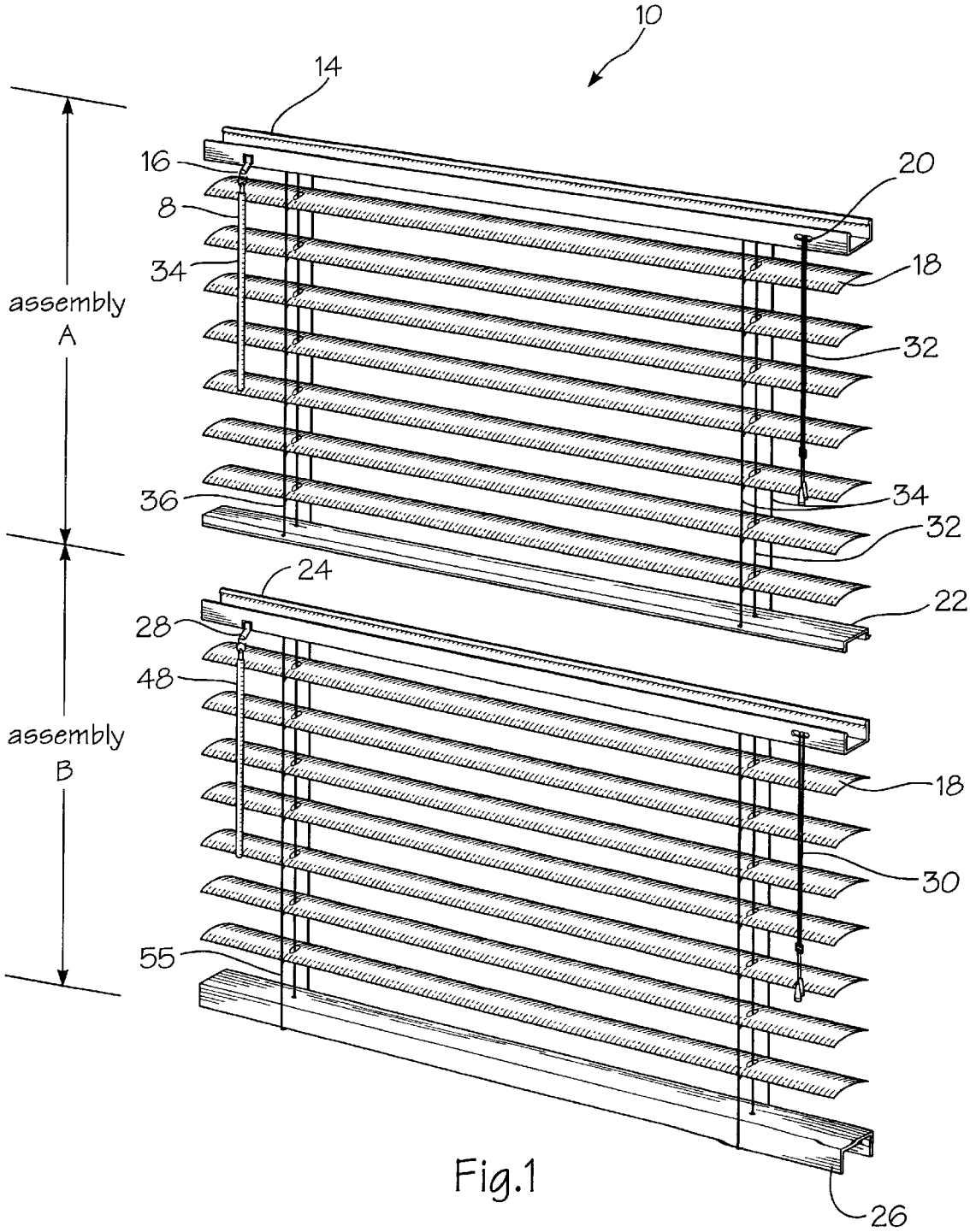
FIG. 1 illustrates a top level perspective view diagram of the preferred embodiment of the present invention with assembly "A" spaced from assembly "B"

The preferred embodiment of the present invention 10, FIG. 1 is a window treatment system for managing the amount of sunlight or artificial light that passes through an opening or window. Any type of opening or window may be used in conjunction with the present invention 10. An example of an opening that may be used in conjunction with the present invention 10 is a recessed area on a wall wherein the present invention 10 is placed or mounted to be a decorative item. Another example of an opening is a passageway connecting adjacent rooms wherein the present invention 10 is placed or mounted to function as a room separator. An example of a window used in conjunction with the present invention 10 is a common window found in many homes or businesses. The window typically separates the interior of the home or business from the exterior of the home or business. If desired the present invention 10 may be expanded into multipliable window treatment systems for managing the amount of sunlight or artificial light passing through an opening or window (see FIG. 3). The present invention 10 may, if desired, be mounted onto any surface that allows the normal operation of the present invention 10. The present invention 10, for example, may be mounted to a window header or window support beams. The present invention 10 may, if desired, be angularly suspended in relation to the horizontal openings or windows. Any angle of the suspension may be implemented that allows the present invention 10 to function.

The window treatment system of the present invention 10, FIG. 1 has a first window treatment section or Venetian blind assembly "A" that is mountable via a head rail or head housing 14 to any convenient surface. The Venetian blind assembly "A" has a tilt control mechanism that when used tilts at least one of a plurality of vertically mounted slats 18. The Venetian blind assembly "A" also has a first lifting cord control mechanism 20 that when is used lifts the bridge rail or bridge housing 22 towards the head housing 14 thereby collapsing the plurality of slats 18.

The window treatment system of the present invention 10, FIG. 1 has a second window treatment section or Venetian blind assembly "B" that has a second plurality of slats 18 connectively suspended between a second bridge rail or bridge housing 24 and a bottom rail or bottom housing 26. The Venetian blind assembly "B" slats 18 of the second window treatment section may, if desired, be the same or different from the slats implemented in the first Venetian blind assembly "A". The Venetian blind assembly "B" has a second tilt control mechanism 28 that when used tilts at least one of the of vertically mounted slats 18. The Venetian blind assembly "B" also has a second lift control mechanism 30 that when used lifts the bottom housing 26 towards the second bridge housing 24 thereby collapsing the plurality of slats 18.

The Venetian blind assembly "A" and Venetian blind assembly "B" are separate and distinct subassemblies of the window treatment system delineated as present invention 10. The Venetian blind assembly "A" functions independent to Venetian blind assembly "B". The first tilt control mechanism 16 and lift control mechanism 20 may, if desired, be used to tilt and first lift the Venetian blind assembly "A" without dependence or connection to the Venetian blind assembly "B". The second tilt control mechanism 28 and second lifting cord control mechanism 30 may, if desired, be used to tilt and lift the Venetian blind assembly "B" without dependence to the Venetian blind assembly "A".

Figure 2:
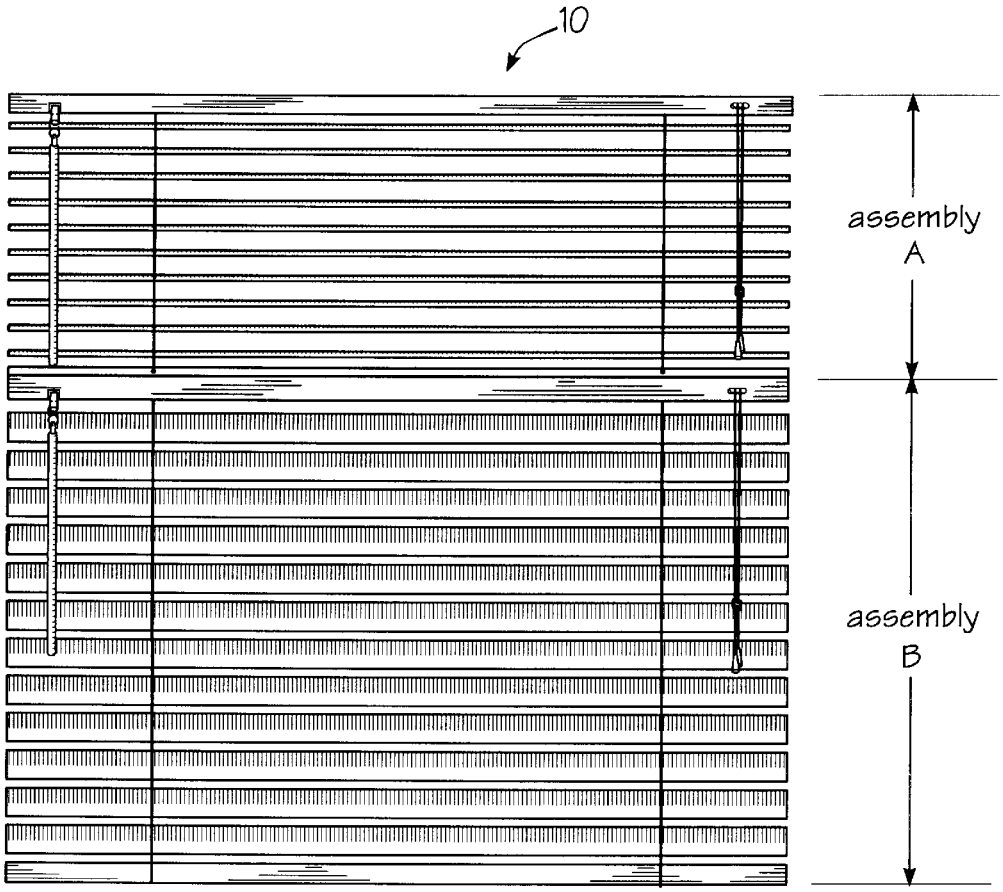
FIG. 2 illustrates a front view diagram of FIG. 1 with assembly "A" adjoined to assembly "B"

The Venetian blind assembly "A" may, if desired, be combined with the Venetian blind assembly "B" to form a single unified window treatment, FIG. 2. The first bridge housing 22 may, if desired, be connected to the second bridge housing 24. The Venetian blind assembly "A" retains all of its independent capabilities when connected to the Venetian blind assembly "B". The Venetian blind assembly "B" like the Venetian blind assembly "A" retains all of its independent capabilities as well.

A MORE DETAILED DISCUSSION OF THE PRESENT INVENTION

The Venetian Blind Assembly "A"

The head housing 14, FIG. 1 is a substantially U-shaped extrusion that is sized to fit any selected opening or window frame. The head housing 14 may, if desired, be fabricated from any convenient material such as metal, plastic, wood, fiberglass or polymer substance. The head housing 14 has a base wall and two perpendicular spaced apart sidewalls connected to the base wall thereby forming an interior opening of the head housing 14. The head housing 14 may, if desired, have at least one aperture disposed in the base wall or sidewalls allowing entry of a lifting cord 32. The head housing 14 may, if desired, have a second aperture disposed in the base wall or sidewalls allowing entry of a tilt control arm 34. The lifting cord 32 may, if desired, be fabricated from any convenient material such as woven cotton, metal, wood, plastic, or any combination thereof. The tilt control arm 34 is pivotally attached to the tilt control mechanism 16. The tilt control arm 34 may, if desired, be fabricated from the same or different materials as the head housing 14.

Figure 6:
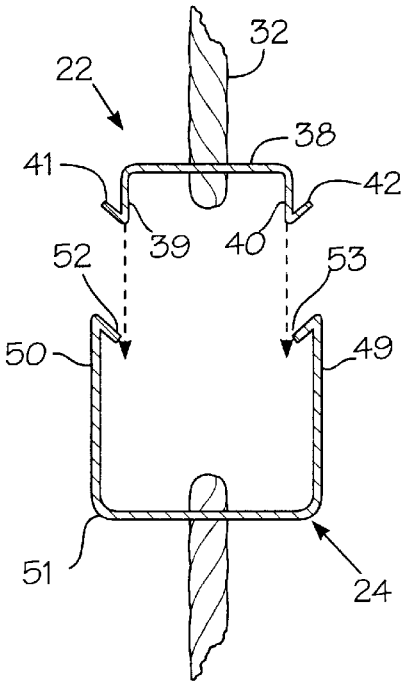
FIG. 6 illustrates an end view diagram of FIG. 5.
Figure 7:
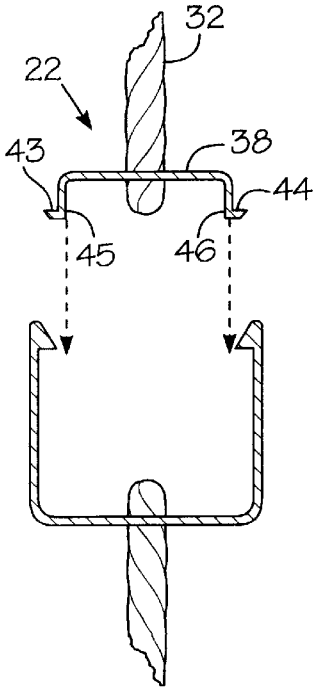
FIG. 7 illustrates an end view diagram of an alternate embodiment of FIG. 5.

The first bridge housing 22 is a substantially U-shaped extrusion that is sized to fit any selected opening or window frame. The first bridge housing 22 may, if desired, be fabricated from the same or different material as the head housing 14. The first bridge housing 22 has a base wall 38, FIG. 6 and two perpendicular spaced apart sidewalls 41 and 42 connected to base wall 38 thereby forming an interior opening of the first bridge housing 22. The sidewalls 41 and 42 each have outwardly protruding rims 41 and 42 extending the longitudinal length of the first bridge housing 22. The sidewalls 41 and 42 may, if desired, be formed to accommodate rims 41 and 42 that are angularly displaced from the horizontal base wall 38 depicted as sidewalls 45, 46 and rims 43, 44, FIG. 7.

The slats 18 are sized to fit within the confines of the opening or window for the Venetian blind assembly "A". The slats 18 are substantially elongated and rectangular. They may, if desired, be convex or concave in shape. Any number of slats 18 may be used in concert with the Venetian blind assembly "A" to manage the amount of sunlight or artificial light that passes through the Venetian blind assembly "A". The number of slats 18 may, if desired, be relative to an image that may be impressed, painted, or imposed on the surface of the slats 18. The total or full image would be visible when the slats 18 are fully or partially tilted. If desired a plurality of images may be imprinted on the surface of the slats 18. The slats 18 are positioned in a parallel arrangement between the head housing 14 and the first bridge housing 22.

A first pair of flexible slat or ladder supports 34 and 36 are connected at one end to the first tilt control mechanism 16 and the other end is connected to the first bridge housing 22. The slats 18 may, if desired, be uniformly disposed along the rungs of the ladder supports 34 and 36.

The first tilt control mechanism 16 is mounted within the head housing 14. The first tilt control mechanism 16 has an extension control arm 34 that when rotated by the user causes the first tilt control mechanism 16 to roll-up or wind the ladder supports 34 and 36 thereby tilting the slats 18.

The Venetian Blind Assembly "B"

The second bridge housing 24 FIG. 1 is a substantially U-shaped extrusion that is sized to fit any selected opening or window frame. The second bridge housing 24 may, if desired, be fabricated from the same or different material as the head housing 14. The second bridge housing 24 has a base wall 51 and two perpendicular spaced apart sidewalls 49 and 50 connected to the base wall 51 thereby forming an interior opening of the second bridge housing 24. The second bridge housing 24 may, if desired, have at least one aperture disposed in the base wall 51 or sidewalls 49 and 50, allowing entry of the second lifting cord 30. The second bridge housing 24 may, if desired, have a second aperture disposed in the base wall 51 or sidewalls 49 and 50, allowing entry of the second tilt control arm 48. The second lifting cord 30 may, if desired, be fabricated from the same or different material as the first lifting cord 32. The second tilt control arm 48 is pivotally attached to the tilt second control mechanism 28. The second tilt control arm 48 may, if desired, be fabricated from the same or different materials as the first tilt control arm 34.

The second bridge housing 24 sidewalls 49 and 50 each have inwardly protruding rims 52 and 53 extending the longitudinal length of the second bridge housing 24. The sidewalls 49 and 50 may, if desired, be formed to accommodate rims 41 and 42 of the first bridge housing 22. The joining of the rims 41, 42 to the rims 49 and 50 detachably secure Venetian blind assembly "A" to Venetian blind assembly "B". The joining operation may, if desired, be a snap-fit enabling the user to unsnap the joined halves with ease.

The slats 18 implemented in the Venetian blind assembly "B" are the same type of slats implemented in the Venetian blind assembly "A" discussed above. The slats 18 are positioned in a parallel arrangement between the second bridge housing 24 and the bottom housing 26. The number of slats 18 implemented in the Venetian blind assembly "B" may, if desired, be relative to an image that may be impressed, painted, or imposed on the surface of the slats. The total or full image would be visible when the slats 18 were fully or partially tilted. If desired a plurality of images may be imprinted on the surfaces of the slats 18 of Venetian blind assembly "A" and "B". The images may, if desired, be coordinated in pictorial imagery, color, and texture.

A second pair of flexible slat or ladder supports 54 and 55 are connected at one end to the second tilt control mechanism 28 and the other end is connected to the bottom housing 26. The slats 18 may, if desired, be uniformly disposed along the rungs of the ladder supports 54 and 55.

The second tilt control mechanism 28 is mounted within the second bridge housing 24. The second tilt control mechanism 28 has an extension control arm 48 that when rotated by the user causes the second tilt control mechanism to roll-up or wind the ladder supports 54 and 55 thereby tilting the slats 18 of the Venetian blind assembly "B".

Figure 5:
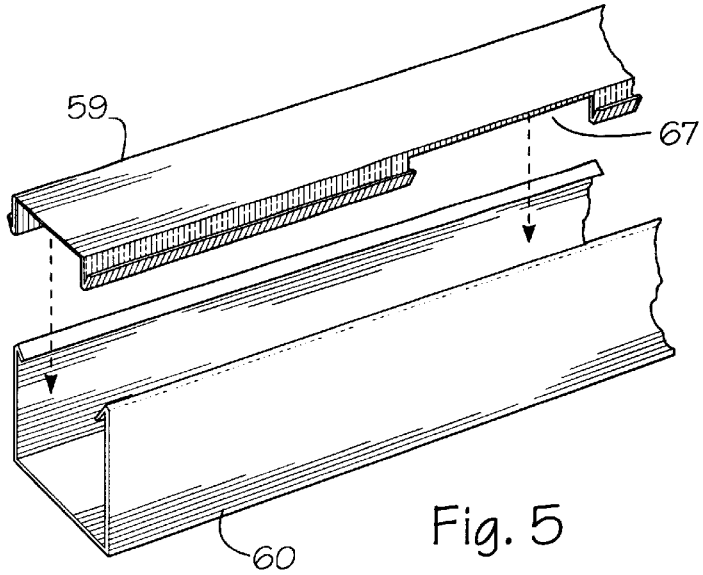
FIG. 5 illustrates a perspective view diagram of a bridge housing.
Figure 8:
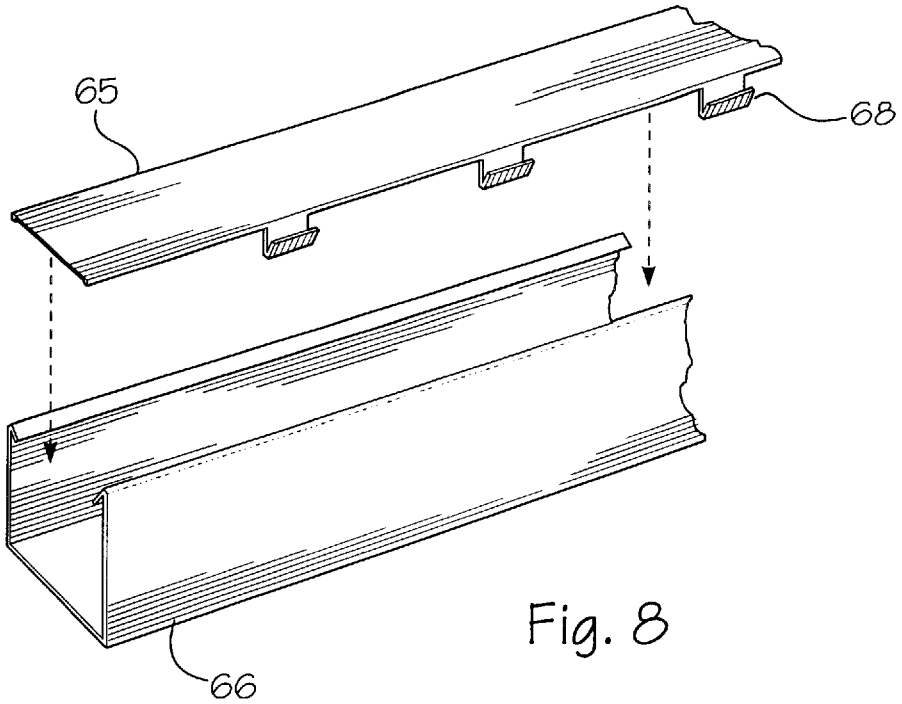
FIG. 8 illustrates a perspective view diagram of an alternate embodiment of FIG. 5.
Figure 9:
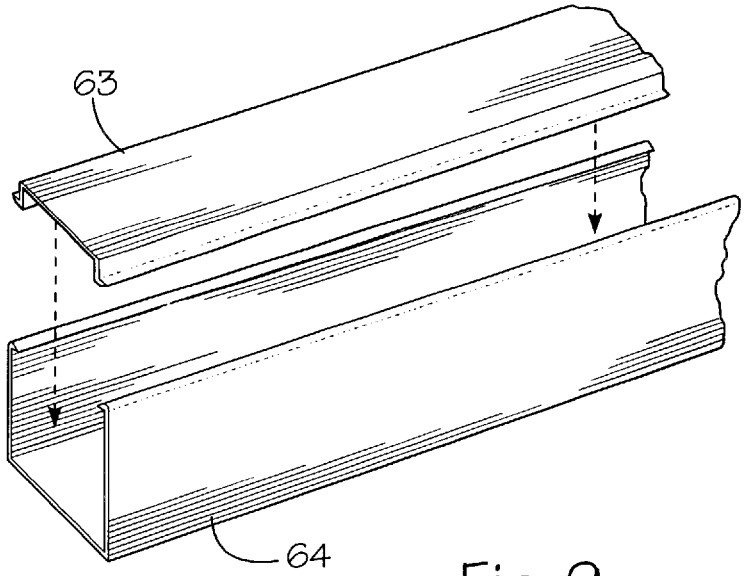
FIG. 9 illustrates a perspective view diagram of an alternate embodiment of FIG. 5.

The first and second bridge housing may, if desired, be implemented in alternate forms. The alternate forms provide the user with other desirable features to alternately adjoin the first and second bridge housing. Examples of alternate first and second bridge housings are: a first bridge housing 59, FIG. 5 that has an aperture 67 disposed in its rim area allowing access to the interior of the second bridge housing 60; A first bridge housing 65, FIG. 8 has a plurality of separate rims 68 that engage the continuous rim of the second bridge housing 66; A first bridge housing 63, FIG. 9 has a substantially rectangular elongated extrusion. The first bridge housing 63 does not have rims to engage the second bridge housing 64. The first bridge housing's 63 bottom surface may, if desired, be affixed to the top surface of the second bridge housing 64 by any convenient means.

In operation of the Venetian blind assembly "A" and "B" are adjoined together to form a complete window treatment. The operational position of the present invention 10, FIG. 3 with respect to managing the amount of sunlight, artificial light, or decorative imagery that is desired by the user is partially illustrated in FIG. 3: The Venetian blind assembly "A" and "B" 70 are in the fully extended mode; The Venetian blind assembly "A" and "B" 71 has the Venetian blind assembly "A" fully retracted and Venetian blind assembly "B" fully extended; The Venetian blind assembly "A" and "B" 72 has both the Venetian blind assembly "A" and "B" fully retracted; The Venetian blind assembly "A" and "B" 73 has the Venetian blind assembly "A" fully extended and the Venetian blind assembly "B" fully retracted; The Venetian blind assembly "A" and "B" 74 has the Venetian blind assembly "A" partially retracted and the Venetian blind assemble "B" fully extended.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together whereas a screw employs a helical surface, in the environment of fastening wooden parts, a nail and a screw may be equivalent structures.

What is claimed is:

1. A window treatment, comprising:

a) a first window treatment defined as: a first head housing; a first bridge housing; at least one slat connectively disposed between said first head housing and said first bridge housing;

b) a first control mechanism operatively disposed within said first head housing, said first control mechanism positionally controlling said slat;

c) a second window treatment defined as: a second bridge housing; a bottom housing; at least one slat connectively disposed between said second bridge housing and said bottom housing;

d) a second control mechanism, operatively disposed within said second bridge housing, said second control mechanism positionally controlling said slat disposed between said second bridge housing and said bottom housing;

e) a snap-fit mechanism detachably securing said second window treatment to said first window treatment;

thereby said first and second window treatments being snap-fitted together, said first and second window treatments being independently and positionally controlled by said first and second control mechanisms.

2. A window treatment as recited in claim 1 further comprising:

f) a first flexible slat support member connectively disposed between said first head housing and said first bridge housing;

g) a second flexible slat support member connectively disposed between said second bridge housing and said bottom housing; thereby said first and second support members providing support to respective slats contained in respective said first and second window treatment.

3. A window treatment as recited in claim 2 wherein each said slat being an elongated flexible rectangle having at least one aperture disposed along its longitudinal length.

4. A window treatment as recited in claim 3 wherein each said slat having a first aperture adjacently disposed at one end of said slat, said slat having a second aperture oppositely spaced from said first aperture along the longitudinal length of said slat.

5. A window treatment as recited in claim 4 wherein said slat of said first window treatment being interchangeable with said slat of said second window treatment.

6. A window treatment as recited in claim 5 wherein said slat of said first window treatment being angularly mounted between said first head housing and said first bridge housing.

7. A window treatment as recited in claim 5 wherein said slat of said second window treatment being angularly mounted between said second bridge housing and said bottom housing.

8. A window treatment as recited in claim 5 wherein said first and second flexible slat support members being fabricated from a material selected from a group consisting of metal, cloth, wood, plastic, or woven material.

9. A window treatment as recited in claim 8 wherein said first and second flexible slat support members being configured in a ladder arrangement for providing support to respective slats contained in respective said first and second window treatments.

10. A window treatment as recited in claim 9 wherein said first control mechanism comprises:

a) a tilt control arm that when rotated causes said slat of said first window treatment to tilt; and b) a lifting control cord traversing said first head housing, said first control mechanism, said aperture of said slat, and connecting to said first bridge housing.

11. A window treatment as recited in claim 10 wherein said second control mechanism comprises:

c) a tilt control arm that when rotated causes said slat of said second window treatment to tilt; and d) a lifting control cord traversing said second bridge housing, said second control mechanism, said aperture of said slat, and connecting to said bottom housing.

12. A window treatment as recited in claim 11 wherein said snap-fit mechanism defined as said second bridge housing being an elongated U-shaped member having sidewalls extending along its longitudinal length, said sidewalls having a pair of inwardly protruding rims extending along their longitudinal length, said first bridge housing being an elongated base wall, said base wall having a pair of depending perpendicular spaced apart sidewalls extending along its longitudinal length, said pair of depending sidewalls having outwardly protruding rims extending along their longitudinal length, said pair of outwardly protruding rims engaging said pair of inwardly protruding rims thereby snap-fitting said first bridge housing to said second bridge housing.

13. A window treatment, comprising:

a) a first elongated U-shaped housing;

b) said first housing connectively disposed to the window;

c) a second elongated U-shaped housing positioned in an aligned spaced apart mirror image relationship with said first housing;

d) said second housing having a pair of outwardly protruding rims extending along its longitudinal length;

e) a first pair of flexible spaced apart slat support members connecting said first housing to said second housing;

f) a first plurality of elongated spaced apart slats medially disposed and aligned with said first and said second housing, each said slat being supported by said pair of slat support members;

g) said plurality of elongated slats each having a pair of spaced apart apertures disposed along the longitudinal length of each said slat;

h) a first control mechanism operatively disposed to said first housing, said first control mechanism having first lifting cord traversing said first control mechanism, said first housing, said apertures of said slats, and connecting to said second housing;

i) a third elongated U-shaped housing aligned with and adjacently spaced to said second housing, said third housing having a pair of inwardly protruding rims extending along its longitudinal length;

j) said third housing's inwardly protruding rims engaging said second housing's outwardly protruding rims, said second housing being snap-fitted to said third housing;

k) a fourth elongated U-shaped housing positioned in an aligned spaced apart mirror image relationship with said third housing;

l) a second pair of flexible spaced apart slat support members connecting said third housing to said fourth housing;

m) a second plurality of elongated slats medially disposed and aligned with said third and said fourth housing, each said slat being supported by said second pair of slat support members;

n) said second plurality of elongated slats each having a pair of spaced apart apertures disposed along the longitudinal length of each said slat;

o) a second control mechanism operatively disposed to said third housing, said second control mechanism having a second lifting cord traversing said second control mechanism, said third housing, said apertures of said second plurality of slats, and connecting to said fourth housing;

p) a first tilting control mechanism operationally disposed in said first housing;

q) said first tilting control mechanism engaging said first pair of slat support members, said first tilting control mechanism having an outwardly extending control arm that when rotated positionally disposes the tilt of said second housing causing said first plurality of slats to responsively tilt;

r) a second tilting control mechanism operationally disposed in said third housing;

s) said second tilting control mechanism engaging said second pair of slat support members, said second tilting control mechanism having an outwardly extending control arm, said outwardly extending control arm when rotated positionally disposes the tilt of said fourth housing causing said second plurality of slats to responsively tilt;

thereby said first lifting cord in concert with said first control mechanism independently positionally controls the lifting of said second housing, said second lifting cord in concert with said second control mechanism independently positionally controls the lifting of said fourth housing.

14. A method for providing a window treatment, comprising the steps of:

a) providing a first window treatment having a first head housing, a first bridge housing, and a first plurality of slats connectively disposed therebetween, said first head housing having a first control mechanism operatively disposed therein, said first control mechanism positionally controlling said first plurality of slats;

b) providing a second window treatment having a second bridge housing, a bottom housing, and a second plurality of slats connectively disposed therebetween, said second bridge having a second control mechanism operatively disposed therein, said second control mechanism positionally controlling said second plurality of slats;

c) snap-fitting said second bridge housing to said first bridge housing;

thereby said first and second window treatments being snap-fitted together, said first and second window treatments being independently and positionally controlled by said first and second control mechanisms, respectively.

* * * * *